US005441119A

United States Patent [19]

Head

[11] Patent Number: 5,441,119

[45] Date of Patent: Aug. 15, 1995

[54] DIRECTIONAL DRILLING TOOL

[75] Inventor: Philip F. Head, London, Great Britain

[73] Assignee: Transocean Petroleum Technology AS, Tananger, Norway

[21] Appl. No.: 140,286

[22] Filed: Oct. 20, 1993

[30] Foreign Application Priority Data

Oct. 23, 1992 [GB] United Kingdom ..... 9222298

[51] Int. Cl.[6] ..... E21B 7/08; E21B 17/02

[52] U.S. Cl. ..... 175/74; 175/45; 175/75; 175/320; 166/237; 166/384

[58] Field of Search ..... 175/61, 45, 73, 74, 175/75, 320; 166/384

[56] References Cited

U.S. PATENT DOCUMENTS

| | | | |
|---|---|---|---|
| 3,667,556 | 6/1972 | Henderson | 175/73 |
| 4,655,299 | 4/1987 | Schoeffler | 175/38 |
| 5,215,151 | 6/1993 | Smith et al. | 175/45 |
| 5,259,467 | 11/1993 | Schoeffler | 175/73 X |
| 5,311,952 | 5/1994 | Eddison et al. | 175/74 X |
| 5,316,093 | 5/1994 | Morin et al. | 175/74 |
| 5,339,913 | 8/1994 | Rives | 175/73 |

FOREIGN PATENT DOCUMENTS

| | | |
|---|---|---|
| 0465072 | 1/1992 | European Pat. Off. . |
| 1494273 | 12/1977 | United Kingdom . |
| 2026063 | 1/1980 | United Kingdom . |
| 2085055 | 4/1982 | United Kingdom . |
| WO80/025-82A | 11/1980 | WIPO . |
| WO86/00111 | 1/1986 | WIPO . |

*Primary Examiner*—Stephen J. Novosad
*Attorney, Agent, or Firm*—Herbert Dubno

[57] ABSTRACT

The invention relates to a directional drilling tool for use in controlled directional drilling. The drilling tool comprises two parts which are moveable relative to each other either in the horizontal or vertical planes. Cam surfaces are provided between the two parts for adjustments to the drilling direction in the vertical plane. A slot and groove mechanism is provided between the two as an example of adjustments in the horizontal plane. In each case hydraulic pressure is the preferred means of controlling the adjustments said controlling means being independent of the other well operations.

17 Claims, 8 Drawing Sheets

DIRECTIONAL DRILLING TOOL

FIELD OF THE INVENTION

This invention relates to directional drilling tools. In particular, the invention relates to directional drilling tools which are used to control the direction of drilling of bore holes.

BACKGROUND OF THE INVENTION

Changes in the direction of drilling of bore holes are required for a number of reasons. The most frequent reason is to change from vertical drilling to horizontal drilling or drilling at any particular angle other than vertical. Horizontal drilling has been known for many years and there are a number of established methods of changing the direction from vertical drilling to horizontal drilling. For example long radius drilling which is used for accessing oil reservoirs in remote locations, under cities, offshore or to avoid geological isolation.

Medium radius drilling is used for pinnacle relief, fractured formations and gas and water coning. Short radius drilling can be used for all these applications. The particular method used is chosen based on the economic considerations of the particular well.

The most common existing method to change the direction of drilling is to use a bent support for the drill bit or a "bent sub" as it is often referred to. Typically a drill bit is used which is powered by a motor and the bent sub is positioned behind the motor. It is also possible for the bent sub to be positioned in front of the motor. The bent sub effectively causes the axis of rotation of the drill be to be at a different angle to that of the drill pipe. Continuous drilling with the bent sub causes continuous changes of direction which results in a curved well hole in the direction of the bend of the bent sub. When the required curvature has been achieved drilling can be stopped and the bent sub changed for a straight sub to resume straight drilling.

Alternatively, the entire drill pipe can be rotated at the surface resulting in a small rotation of the bent sub, motor and drill bit assembly. The bend of the bent sub is now positioned in a different direction and drilling can be resumed in this different direction.

Positional sensors such as gyroscopic sensors are used to check the progress and direction of the drilling to establish what adjustments to the drilling angle are required.

A disadvantage of this existing method of directional drilling is that the drilling tool has to be removed from the bore hole and changed before drilling in the straight direction can be recommenced. This results in an expensive operation and increases the time to complete the required drilling.

A further disadvantage is that when drilling is restarted in a new direction it is often the case that the drill bit kicks in an unpredictable direction due to unevenness in the hardness of the formation at the point of stoppage of the drill head.

A further disadvantage with this known method is that control of the direction of the drill bit is inaccurate because it relies on rotation of the whole of the drill pipe which can result in unpredictable degrees of rotation of the drill bit. Furthermore in some applications such as with the use of continuous drill pipe it is not practical to rotate the drill pipe.

OBJECT OF THE INVENTION

It is an object of the present invention to provide a directional drilling tool which can be controlled remotely and accurately.

SUMMARY OF THE INVENTION

According to a first aspect of the present invention there is provided a drilling tool comprising an upper part and a lower part with means between the upper part and lower part for permitting controlled relative rotation of the said upper and lower parts. The adjustment means is controlled by remote commands such as from the surface of an oil well and the control is independent of other oil well operations such as the flow of oil well fluids.

According to a further aspect of the invention rotation of the upper part relative to the lower part is caused by hydraulic pressure. The hydraulic pressure is provided by a hydraulic fluid which is contained in a closed circuit within the directional drilling tool.

In a further aspect of the invention the lower part is telescopically arranged within the upper part and hydraulic pressure is provided by a piston which causes the lower part to move laterally with respect to the upper part. Relative rotation is thereby achieved by means of a key running in a slot in either the lower or upper parts which extends around the circumference of the lower or upper parts. The lower and upper parts are thereby constrained to rotate with respect to each other as the hydraulic piston is pressurized.

In a further aspect of the invention rotation of the upper and lower parts is provided by a stepper motor.

In a further aspect of the invention relative rotation of the upper and lower parts is provided by a clutch control mechanism.

In a preferred embodiment of the invention the upper part is connected to the drill pipe and the lower part is connected to a fixed bent sub. The bent sub can be rotated into the required direction for drilling.

In a further preferred embodiment of the invention the upper and lower parts comprise cam engaging surfaces which cause the axes of the upper and lower parts to change with respect to each other as they are rotated with respect to each other said adjustment means being controlled by remote commands such as from the surface of an oil well and said control being independent of other oil well operations such as the flow of oil well fluids. The upper and lower parts can be locked in a required position with respect to each other. Thus a bent sub can be created as required while the tool remains down hole. The adjustment means can be provided by hydraulic power.

BRIEF DESCRIPTION OF THE DRAWING

An embodiment of an orientation tool in accordance the invention, will now be described, with reference to the accompanying drawings, in which.

DESCRIPTION OF THE PREFERRED EMBODIMENTS

Figure 1:
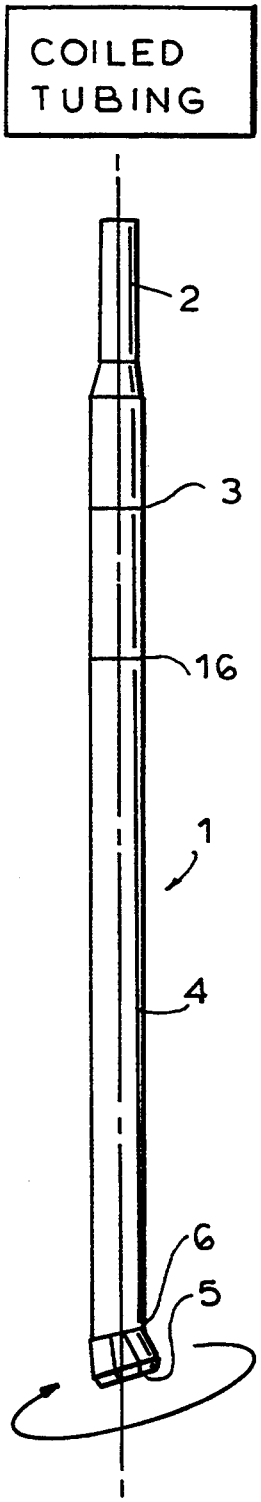
FIG. 1 is a longitudinal cross-section of an orientation tool according to the invention in a first orientation.

Referring firstly to FIG. 1, the first orientation tool 1 in accordance with the invention comprises a support sub 3 which is connected to the drill pipe 2, a motor 4, which drives a drill bit 5 and a bent motor support sub 6. The drill pipe 2 referred to throughout this specification can either be conventional drill pipe comprising sections connected together or alternatively, and preferably to achieve the full advantages of the present invention, a continuous coiled tubing type drill pipe.

Figure 2:
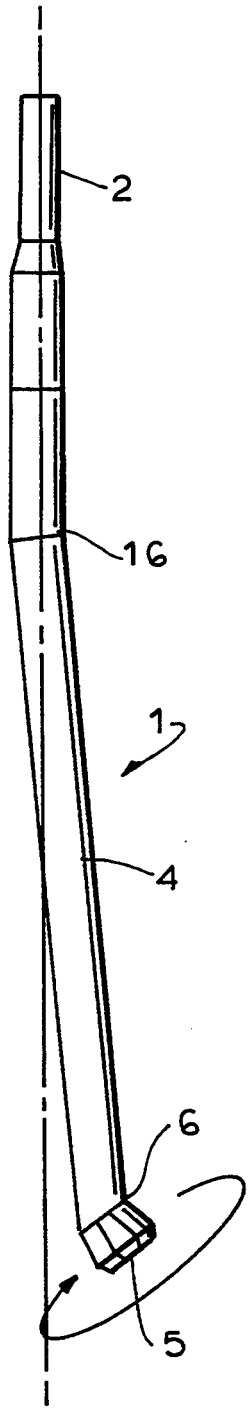
FIG. 2 is an orientation tool according to the invention in a second orientation.

It is possible to have a bent support sub either between the motor 4 and the drill bit 5 or between the motor 4 and the drill pipe 2. Referring to FIG. 2 the orientation tool comprises a bent sub 16 between the motor 4 and the drill pipe 2 as well as a bent sub 6 between the motor 4 and the drill bit 5. This combination can result in a much sharper curvature or greater build up angle. This is often desirable and possible when continuous coiled tubing is used.

Figure 3:
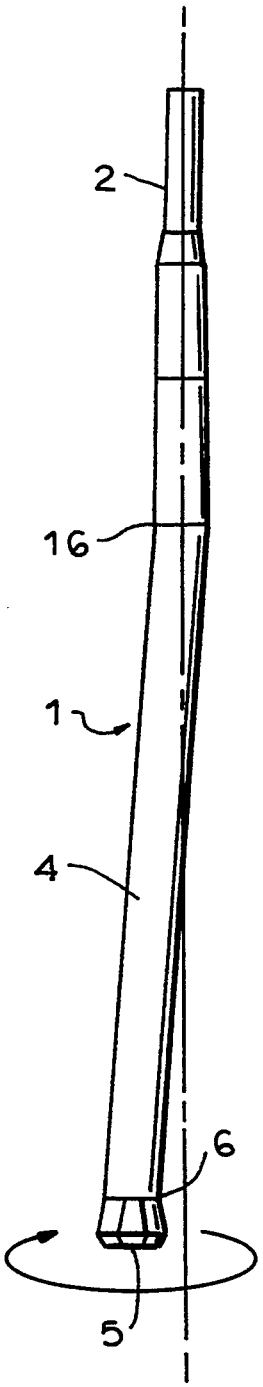
FIG. 3 is an orientation tool according to the invention in a third orientation.

Referring to FIG. 3 the bent sub 16 between the motor 4 and the drill pipe 2 is bent in the opposite direction to the bent sub 6 between the motor and the drill bit. This results in the drill bit face being perpendicular to the centre line of the drill pipe. Thus with this configuration it is possible to drill in a straight line.

According to the invention a variable bent sub 16 is positioned between the motor and the drill pipe. In FIG. 1 the variable bent sub 16 is in the "neutral" aligned position which results in a conventional bent sub arrangement in combination with the fixed bent sub 6. In FIG. 2 the variable bent sub 16 is adjusted to change the alignment in the same direction as the alignment of the bent sub 6. Thus the same double bent sub effect is created which can be used for high build up angles. In FIG. 3 the variable bent sub 16 is adjusted to change the alignment in the opposite direction to the fixed bent sub 6. This results in the resultant alignment of the drill bit being the same as the original drill pipe which would produce drilling in a straight line once more.

By varying the bent sub 16 it is possible to achieve all of the three configurations described above without replacing any parts of the tool. Indeed the angle of the variable bent sub 16 can be varied while drilling is in progress with weight on the bit. This gives much more accurate control of the direction of the drilling process. With all conventional systems it is necessary to stop drilling to change the drilling angle. With the system according to the invention drilling continued as measurements of the required direction are taken and corresponding adjustments to the drilling direction are made.

Figure 4:
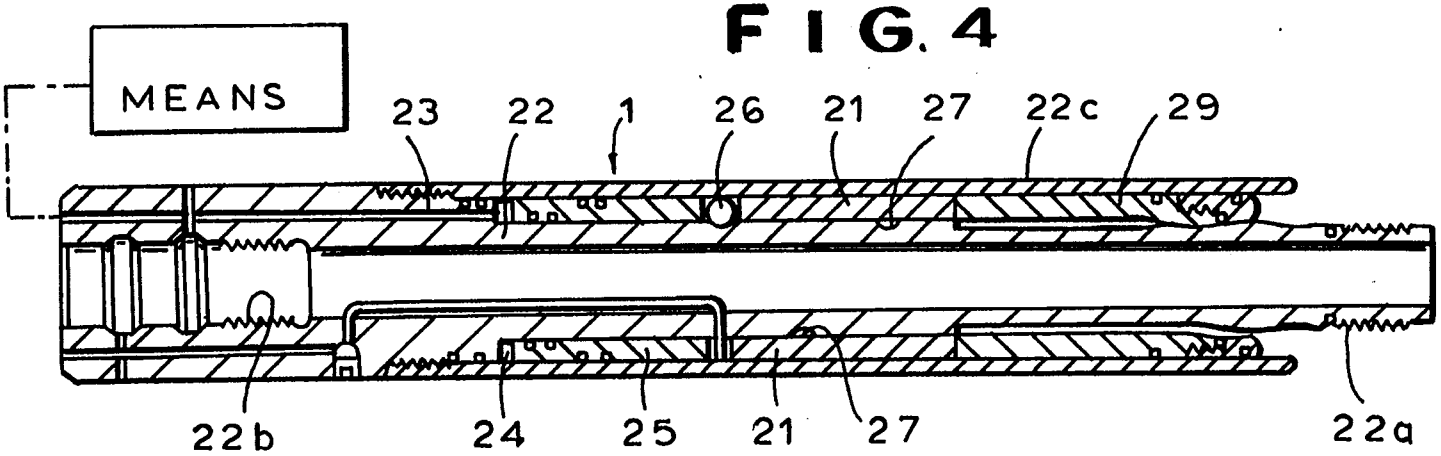
FIG. 4 is a longitudinal cross-section of a hydraulic orientation tool according to the invention.
Figure 5:
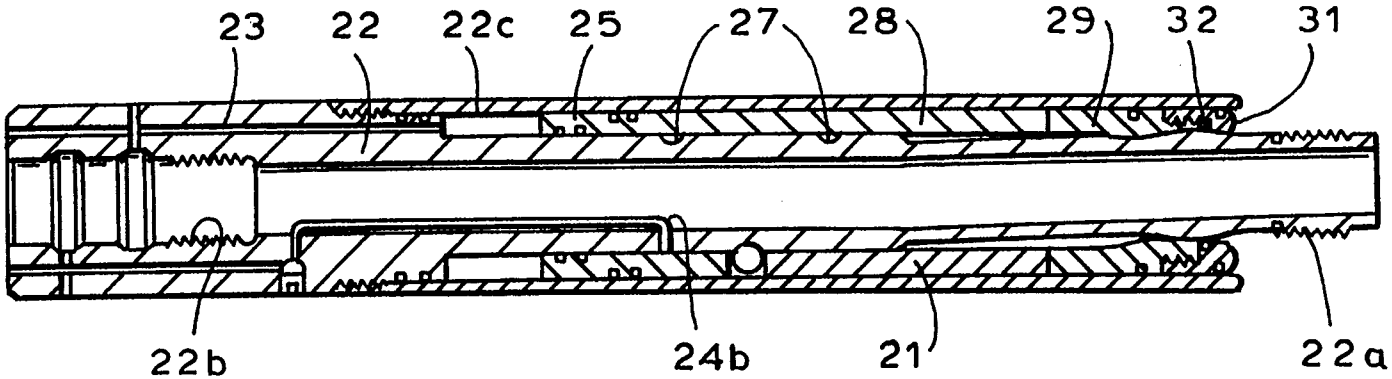
FIG. 5 is a sectional view which shows the orientation tool of FIG. 4 in an alternative position.

FIGS. 4 and 5 show how the variable bent sub 16 works. The hydraulic directional drilling tool 1 comprises a inner part 22 which is connected to the drill pipe 2 by the connector and which is arranged telescopically within an outer part 21. A piston 25 is arranged between the inner part 22 and an outer sheath 22*c* between the inner part and the outer sheath a hydraulic chamber 24 is provided. A hydraulic line 23 feeds into the hydraulic chamber 24 to pressurize the chamber 24 and drive the piston 25 is also part of the inner part 21. The outer part 21 comprises a ball bearing 26 located in a hole in its inside surface. The ball bearing 26 is in turn located in a groove 27 which extends in the form of a helix around the circumference of the inner part 22.

When it is required to adjust the relative position of the inner and outer parts the pressure in the hydraulic line 23 and chamber 24 is increased and the piston 25 is forced to move laterally against the ball bearing 26. The ball bearing 26 travels in the groove 27 thus causing the outer part 21 to rotate with respect to the inner part 22. A further hydraulic line 24*b* controls the hydraulic pressure in the other direction the piston to permit the movement of the inner and outer parts 22, 21 in the reverse direction. When the required extent of rotation has been achieved the pressure is returned to the equilibrium pressure and the new position is maintained.

Torque from the turning of the drill bit will have the tendency to force the upper and lower parts to rotate with respect to each other. The equilibrium pressure in the chamber 24 will serve to maintain the lower and upper parts in the required relative position. Automatic feedback of any changes in position caused by changes in the torque from the drill bit and motor can be countered by corresponding changes in pressure in the chamber 24 to maintain the upper and lower parts in the required relative position.

Referring to FIG. 5, the outer and inner parts 21, 22 comprise corresponding cam surfaces 31, 32. The cam surfaces are contoured such that, when the piston and inner parts are rotated with respect to each other as described above, the inner part 22 is adjusted to a position which is off line with respect to the original center line and the center of the drill pipe 2. Thus a bent sub is created and drilling can be continued in a new direction following drilling of a straight direction. When the extent of curved drilling is complete straight drilling can be resumed without the need to replace the drilling tool. This avoids the need to change the directional drilling tool when changing from curved drilling to straight drilling. The directional drilling tool can be fitted at the commencement of drilling and will not need to be replaced by a bent sub when the stage of a change in direction is required. The directional drilling tool can drill in a straight line for the first vertical section, then be adjusted for the curved section, and adjusted once more of a further straight section. By means of this invention the direction of drilling can be varied on a continuous basis and by any required amount in increments as small as required.

Alternatively the outer part 21 is connected e.g. at *22b* directly to a fixed bent sub 6 which is in turn connected to the drill bit 5 or to the upper end of the motor 4 depending on the configuration required of the combinations of FIGS. 1–3. Relative rotation of the inner part and the outer piston will then result in rotation of the bent sub 6 with respect to the drill pipe 2. By this embodiment it is therefore possible to accurately control the rotation of the directional drilling tool. The direction of drilling can be changed and controlled with out interruption to the drilling itself and without the requirement to rotate the whole of the drill pipe 2.

Figure 12:
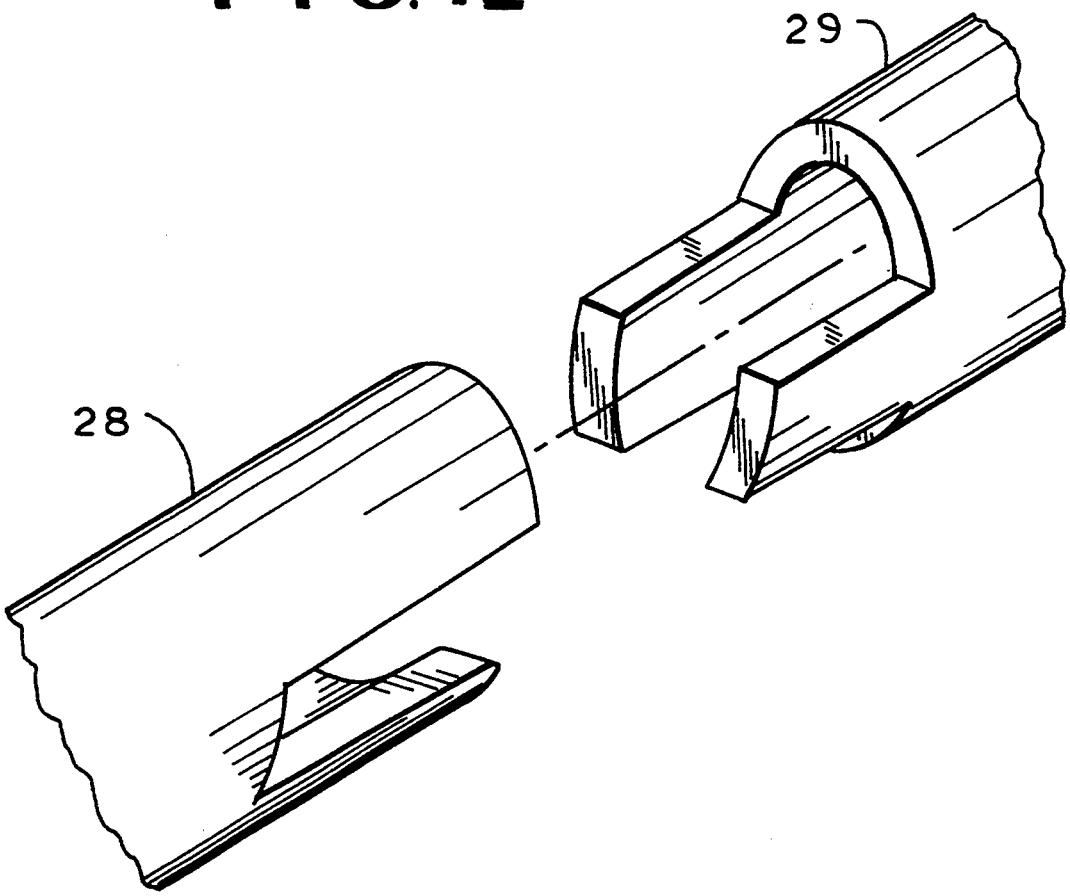
FIG. 12 is a perspective view of the outer part of FIGS. 4 and 5.

Referring to FIG. 12 the outer part 21 comprises two interlocking parts 28, 29 such that the piston can translate part 28 without imparting a translating force on the second part 29 and yet at the same time rotation of part 28 results in an equivalent rotation of part 29.

Information from on-line positional sensors can be fed back to the control center and the direction of drilling can be adjusted accordingly as drilling progresses.

Figure 6:
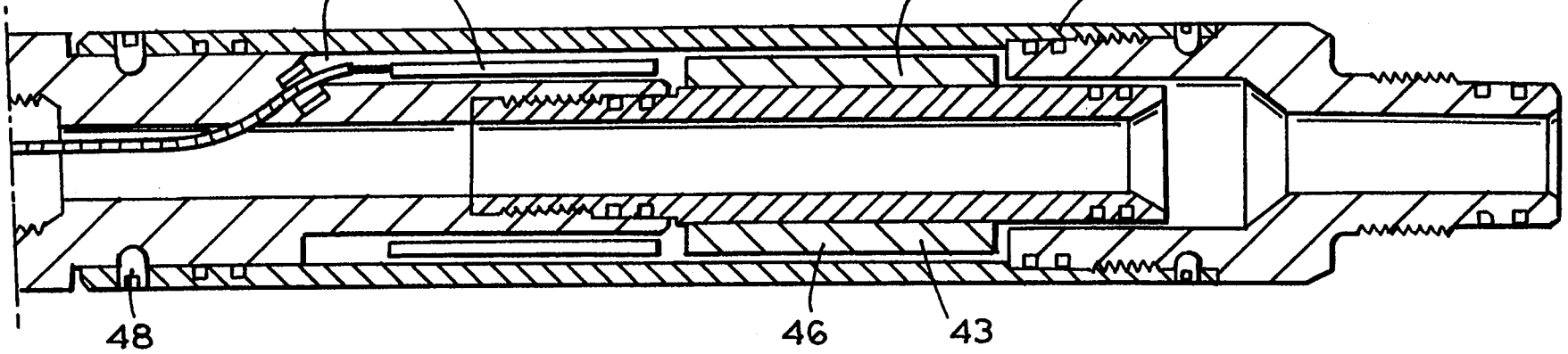
FIG. 6 is a longitudinal cross section of a stepper motor controlled orientation tool according to the invention.

FIG. 6 shows a further embodiment of the directional drilling tool 1 according to the invention controlled by a stepper motor 43 rather than by hydraulic means. The directional drilling tool 1 comprises an upper part 41, a lower part 42 and a stepper motor 43 arranged between them. The stepper motor 43 comprises a coil 46 a controller 44 and an electrical connecter and power cable which is fed through the wall of the drill pipe 2. The upper part 41 forms part of the mandrel of the stepper motor 43 including the magnet part and the lower part 42 forms part of the housing of the stepper motor 43 including the coil 46. Thus relative rotation of the upper and lower parts can be achieved by the motor 43 in increments as low as 0.9 degrees. Nor is there any limit to the number of complete rotations of the lower part with respect to the upper part. This provides the drilling tool with greater flexibility. The precise rotation of the motor is controlled by the controller 44.

Locking pins 48 retain the lower part 42 in the required position with respect to the upper part 41 while permitting rotational movement between them.

Information about the position of the directional drilling tool can be obtained using a positional sensor and fed to the controller to make whatever adjustments necessary to achieve the required position. Once a particular position has been determined the stepper motor can maintain the position and resist any reactive torque from the drill bit.

As with the previous embodiment it is possible to fix the lower part 42 to a fixed bent sub, so that the direction of drilling can be changed by rotation of the lower part 42. Alternatively or additionally the lower and upper parts may comprise a cam surface between them so that relative rotation creates a bent sub in the desired direction so that directional drilling can commence. Adjustments can be made to the required relative position of the upper and lower parts and hence to the direction of drilling whilst the drilling is in progress and there is weight on the drill bit.

Figure 7:
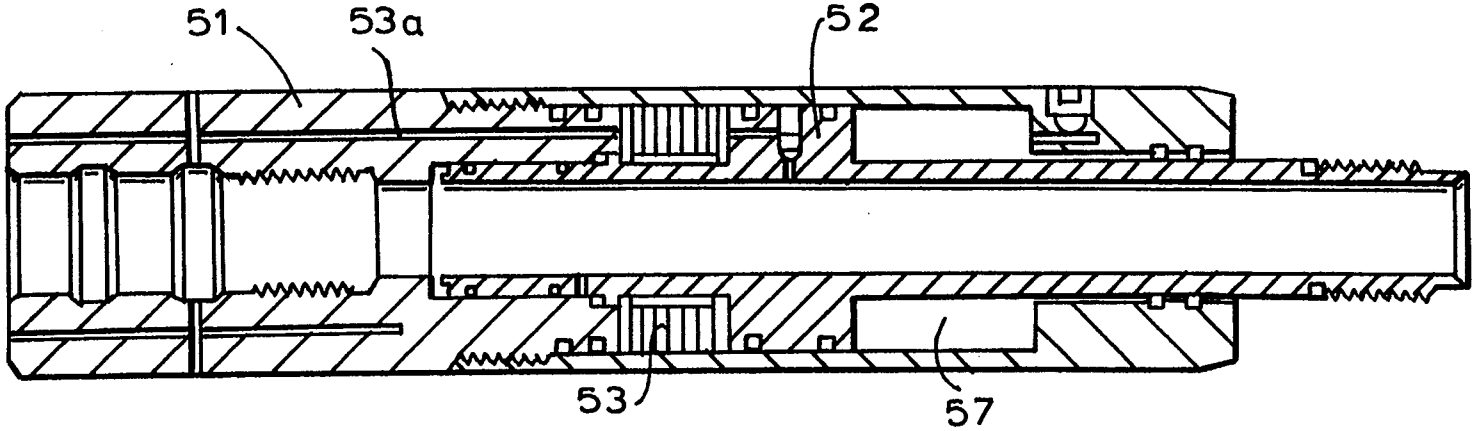
FIG. 7 is a longitudinal cross section of a clutch controlled orientation tool according to the invention.

FIG. 7 shows a further embodiment of the directional drilling tool 1 according to the invention controlled by a clutch 53. The directional drilling tool 1 comprises an upper part 51, a lower part 52 and a clutch 53 arranged between them. The clutch 53 is pressurized by reservoir 57 of nitrogen pressure which locks the upper part 51 and lower part 52 together. During the course of drilling there will be a tendency for the upper and lower parts to rotate with respect to each other. This is resisted by the nitrogen pressure acting on the clutch.

When relative movement of the upper and lower parts is required, the pressure on the clutch 53 is countered by applying hydraulic pressure valve **53*a* which releases the clutch and allows the lower part 52 to rotate by virtue of the torque from the drill bit. When the lower part 52 is in the required position with respect to the upper part 51** the hydraulic pressure is removed from the clutch leaving the nitrogen pressure to lock the upper and lower parts together again.

As with the previous two embodiments the upper and lower parts can be connected to the respective drill pipe, motor and drill bit parts according to the required arrangement. Similarly the control of the clutch can be governed according to information about the position of the directional drilling tool transmitted from a positional sensor.

By this embodiment accurate and infinite relative rotation of the upper and lower parts is possible. No external power source is required to achieve the required rotation. However the adjustments can only be made when the drill bit is rotating.

Figure 8:
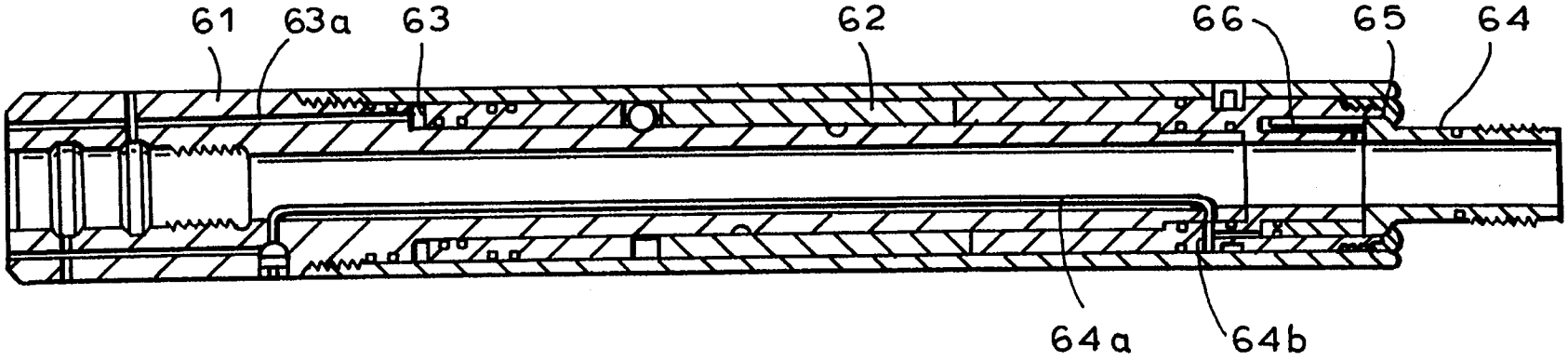
FIG. 8 is a longitudinal cross section of a further embodiment of the hydraulic controlled orientation tool according to the invention.
Figure 9:
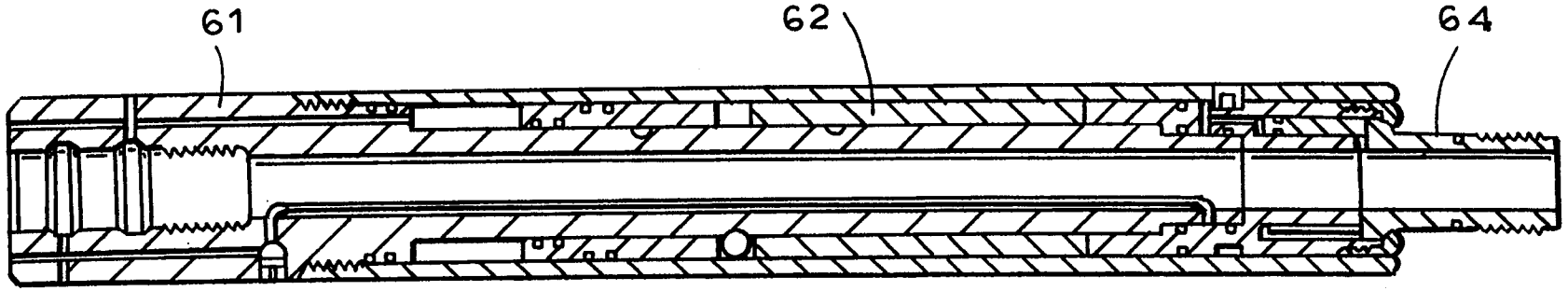
FIG. 9 is a section which shows the orientation tool of FIG. 8 in an alternative position.

A further embodiment of the invention is shown in FIGS. 8 and 9. The embodiment shows a hydraulic directional drilling tool similar to the embodiment shown in FIGS. 4 and 5. In this embodiment the orientation tool comprises two hydraulic systems. The first hydraulic system represented by lines **63*a* controls the orientation or degree of rotation of the upper and lower parts 61, 62 by means of a hydraulic piston 63** in the manner described above.

The second hydraulic system represented by lines **64*a*, 64*b* operates an additional sub part 64 which is telescopically connected to the lower part 62. Cam surfaces 65 are arranged between the lower part 62 and the additional lower part 64 such that when the additional sub part 64 is rotated with respect to the lower part 62 the cam surfaces 65 cause it to be off line with respect to the lower part 62. Returning spring means 66, which for example comprise a rubber mounted vibration damper, are provided to return the lower part 62 to the straight position with respect to the upper part 61**, when the hydraulic pressure is released. Thus providing a variable bent sub arrangement.

The variation of the angle of the variable bent sub is independent of the variation of the orientation caused by relative rotation of the upper and lower parts. This combination of independent variable orientation and variable bent sub provides infinite variability of the required directions to be drilled.

Figure 10:
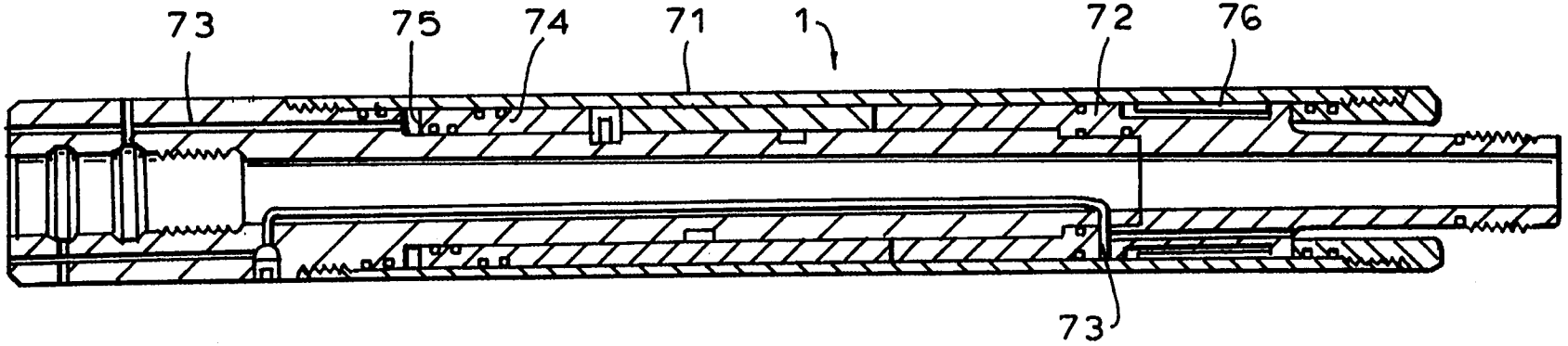
FIG. 10 shows a longitudinal cross section of a further embodiment of the hydraulic controlled orientation tool according to the invention.
Figure 11:
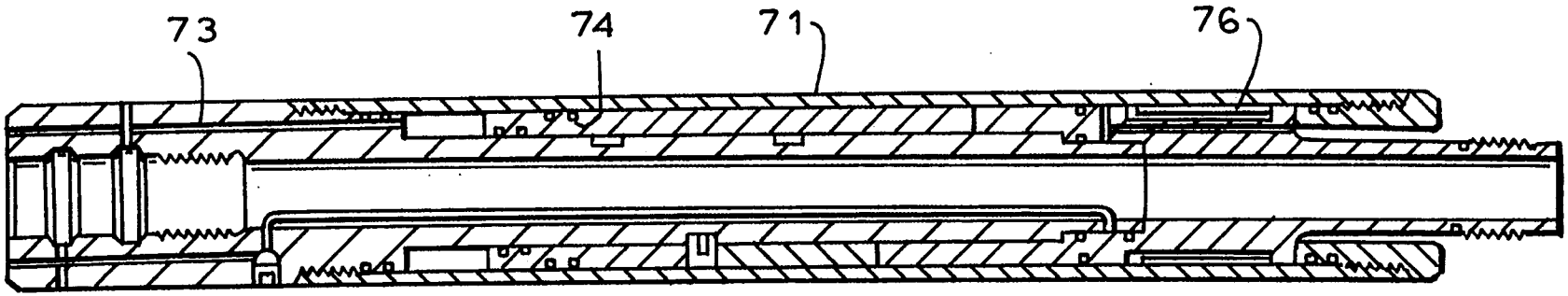
FIG. 11 is another section which shows the orientation tool of FIG. 10 in an alternative position.

Referring now to FIGS. 10 and 11, these figures show an adaptation of the embodiment of the hydraulic directional drilling tool of FIG. 4. A locking means 76, comprising for example a pressurized packer, is provided between the upper part 71 and the lower part 72. The locking means can be activated by applying hydraulic pressure via line 73 and released by reducing the hydraulic pressure. Thus when the required relative orientation is achieved by rotation of the lower part 72 with respect to the upper part 71, the upper and lower parts can be locked together by activating the locking means 76. This avoids the reliance on the hydraulic pressure in the piston 74 to maintain the two parts in the required position with respect to each other.

Figure 13:
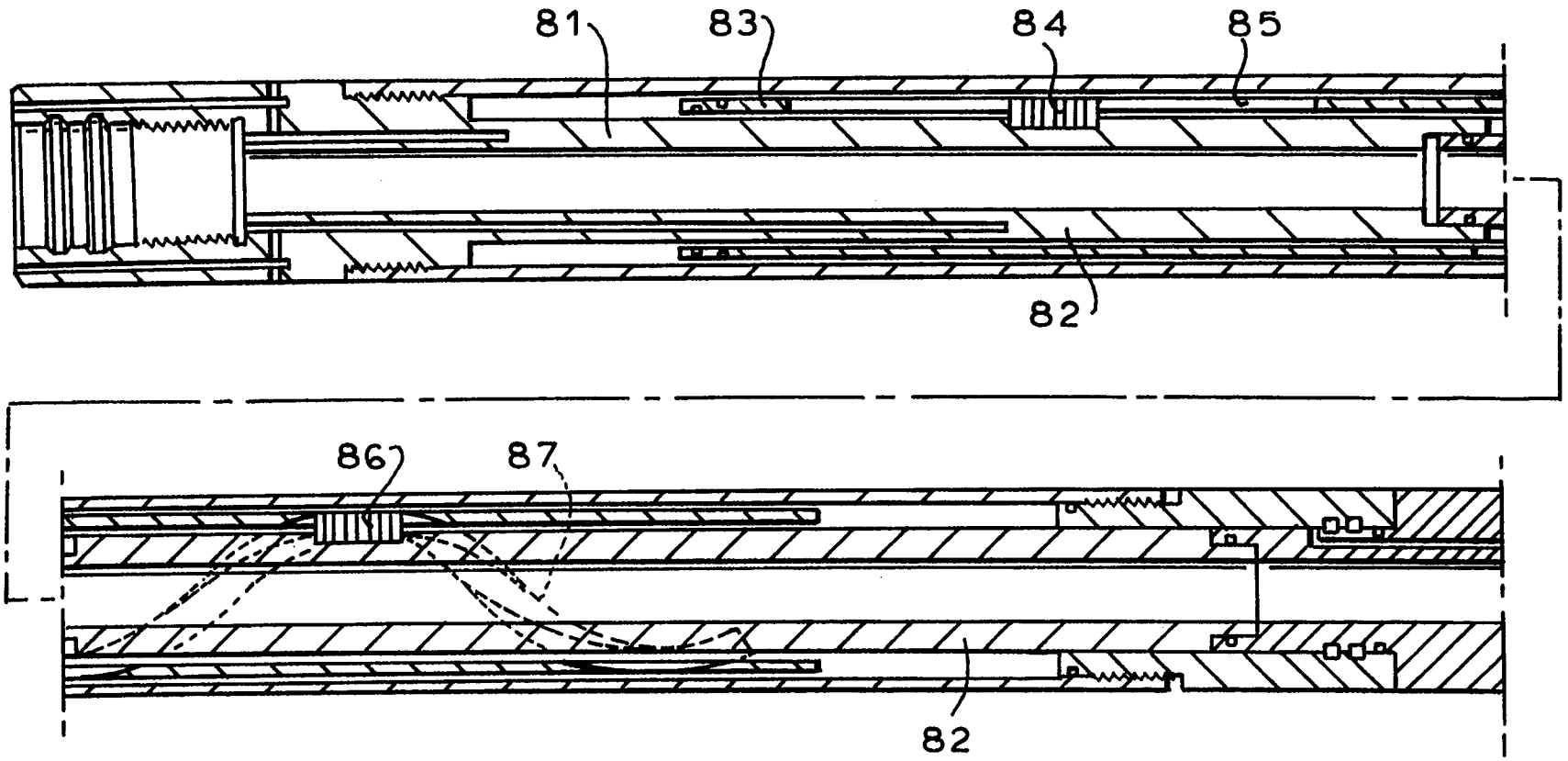
FIG. 13 is a longitudinal cross section of a further embodiment of the hydraulic orientation tool according to the invention.

Referring now to FIG. 13 a further embodiment of the orientation tool according to the invention is shown. The orientation tool comprises an upper part 81 and a lower part 82 which are telescopically arranged with respect to each other. A piston 83 is arranged concentrically around the inner and upper part 81 and is aligned with or forms part of the lower or outer part 82 and which can move in an axial direction under hydraulic pressure. In this embodiment an upper key 84 is arranged in a longitudinal slot 85 between the piston and the upper part 81 and a lower key 86 is arranged in a helically shaped slot 87 between the piston and the lower part 82. By means of this mechanism the application of hydraulic to the piston will result in rotational movement of the lower part 82 with respect to the upper part 81. Hydraulic lines 88 and 89 are provided to apply pressure to either side of the hydraulic piston 83.

Figure 14:
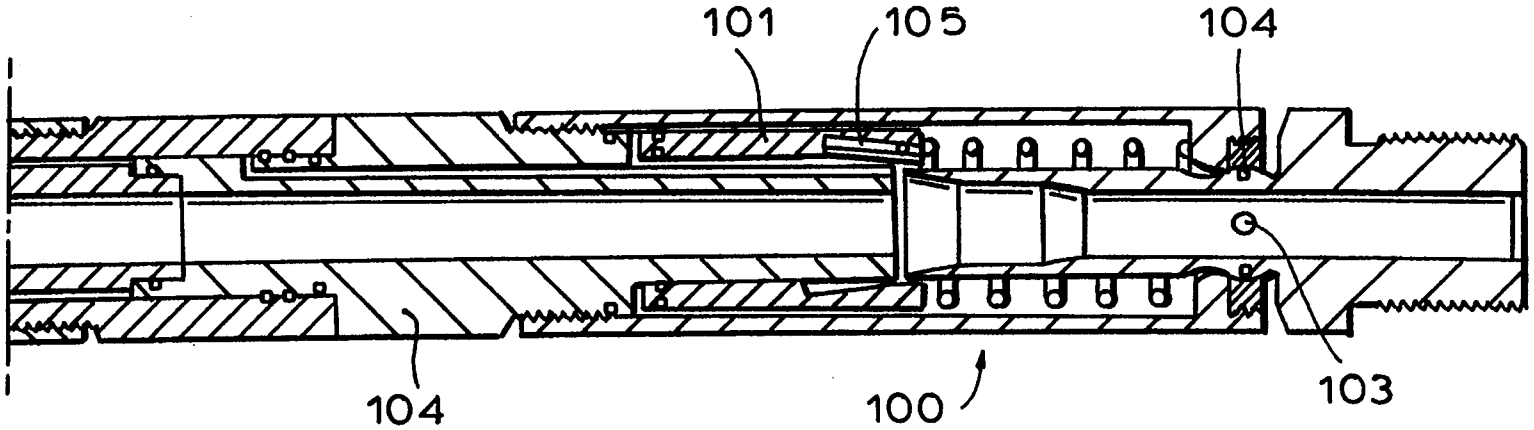
FIG. 14 is a longitudinal cross section of a further embodiment of the hydraulic orientation tool according to the invention.

Referring to FIG. 14 a variable bent sub extension 100 is shown which is connected to the lower part 82 of the orientation tool. The variable bent sub comprises an upper support part 101 and a lower drill bit part 102. The upper support part 101 comprises an inclined piston 105 which when activated act against the lower drill bit part 102 to cause it to pivot about the axis 103 by means of the cam surfaces 104.

The piston 105 can be powered by the same hydraulic fluid from the piston chamber in the orientation tool described above and the release of the fluid can be controlled to the desired extent by appropriate valve means.

In a final embodiment of the invention it is also possible to use hydraulic packing means to adjust the relative positions of the lower and upper parts. Inflatable packers would be appropriately positioned to act on surfaces of the lower and/or upper parts to cause them to move relative to each other. This movement can either be rotational to change the orientation of an existing bent sub, or alternatively, and also additionally, movement of a cam surface which creates a change in the alignment of one of the lower or upper parts with respect to the other, thereby producing a variable bent sub.

I claim:

1. A directional drilling system for providing selectively changes in a direction of drilling in a vertical plane by variation in a bend angle and in an azimuth angle in a horizontal plane, said system comprising:

a coiled drilling tube fed from above into a borehole from a surface from which said borehole is drilled;

a tubular directional drilling tool comprising an upper end fixed to an end of said coiled tube and a lower end;

a drill bit below said lower end and secured thereto, a drilling fluid passing through said tube and said tool to said drill bit, said drilling tool comprising:

relatively rotatable first and second parts whose relative rotation determines at least one of said angles, means between said relatively rotatable first and second parts for varying one of said angles between said coiled drilling tube and said drill bit at said drilling tool upon relative rotation of said parts, and a mechanism in said drilling tool operable independently of said drilling fluid and flow thereof for rotating one of said parts relative to the other of said parts; and control means for said mechanism including a transmission line running to said mechanism from the surface for controlling the determination of said one of said angles independently of said fluid and without rotation of the coiled tube.

2. A directional drilling system according to claim 1 wherein the mechanism comprises a hydraulic piston, said transmission line being a hydraulic line.

3. A directional drilling system according to claim 1 wherein the mechanism comprises a key and slot mechanism.

4. A directional drilling system according to claim 3 wherein the key and slot mechanism comprises a curved slot.

5. A directional drilling system according to claim 1 wherein the mechanism comprises a stepper motor.

6. A directional drilling system according to claim 1 wherein the mechanism comprises a releasable clutch mechanism.

7. A directional drilling system according to claim 1 wherein at least one of the upper and lower ends is connected to a bent sub.

8. A directional drilling system according to claim 1 wherein at least one of said first and second parts comprise cam surfaces.

9. A directional drilling system according to claim 8 wherein said cam surfaces are such that rotation of the second part with respect to the first part results in a center line of the first part being in a different direction to the center line of the drill pipe.

10. A directional drilling system according to claim 1 wherein a third part is arranged between the first and second parts, and such that adjustments can be made to the bend angle and the azimuth angle of drilling without rotating or withdrawing the coiled tube.

11. A directional drilling system according to claim 10 wherein relative adjustments can occur between said first and third parts or said second and third parts.

12. A directional drilling system according to claim 11 wherein relative rotational adjustments can occur between said first and third parts or said second and third parts.

13. A directional drilling system according to claim 10 wherein cam surfaces are arranged between said first and third parts or between said second and third parts.

14. A directional drilling system according to claim 13 wherein the cam surfaces are arranged so that relative adjustment of said first or second parts with respect to said third part results in the center line of said first or second parts being in a different direction from the center line of said first part.

15. A directional drilling system according to claim 1 wherein the mechanism is powered by hydraulic fluid.

16. A directional drilling system according to claim 1 wherein a releasable locking means is arranged between the first and second parts to lock said first and second parts together.

17. A directional drilling system according to claim 16 wherein said locking means comprise a packing means.

* * * * *